US008793987B2

(12) United States Patent
Berger et al.

(10) Patent No.: US 8,793,987 B2
(45) Date of Patent: Aug. 5, 2014

(54) HEAT EXCHANGER PLATE AND AN EVAPORATOR WITH SUCH A PLATE

(75) Inventors: Jürgen Berger, Gerstetten (DE); Peter Ambros, Kusterdingen (DE); Axel Fezer, Ebersbach an der Fils (DE); Jochen Orso, Reutlingen (DE); Harald Necker, Nürtingen (DE)

(73) Assignee: SteamDrive GmbH, Heidenheim (DE)

( * ) Notice: Subject to any disclaimer, the term of this patent is extended or adjusted under 35 U.S.C. 154(b) by 80 days.

(21) Appl. No.: 13/453,701

(22) Filed: Apr. 23, 2012

(65) Prior Publication Data

US 2012/0255288 A1 Oct. 11, 2012

Related U.S. Application Data

(63) Continuation of application No. PCT/EP2010/006467, filed on Oct. 22, 2010.

(30) Foreign Application Priority Data

Oct. 23, 2009 (DE) ..... 10 2009 050 500

(51) Int. Cl.
*F01N 5/02* (2006.01)
*F01K 23/06* (2006.01)
*F28D 15/00* (2006.01)

(52) U.S. Cl.
USPC ..... 60/320; 60/670; 165/104.14; 165/104.19; 165/104.21

(58) Field of Classification Search
USPC ..... 60/320, 670; 165/104.14, 104.19, 165/104.21, 104.22
See application file for complete search history.

(56) References Cited

U.S. PATENT DOCUMENTS 3,983,191 A 9/1976 Schauls
4,249,595 A 2/1981 Butt (Continued)

FOREIGN PATENT DOCUMENTS

DE 30 28 304 A1 2/1981
DE 30 28 304 C2 5/1985

(Continued)

OTHER PUBLICATIONS

International Search Report dated Mar. 1, 2011 for PCT/EP2010/006467 (6 pages).

(Continued)

*Primary Examiner* — Audrey K Bradley
(74) *Attorney, Agent, or Firm* — Taylor IP, P.C.

(57) ABSTRACT

A heat exchanger plate for an evaporator includes a flow transverse distribution device. Disks of the flow transverse distribution device conduct the medium to be evaporated to the flow channel extending in the direction of the longitudinal axis. The disks include openings allowing a flow of the medium in the direction of the longitudinal axis with comparatively higher flow resistance than in the direction of the transverse axis. The number of disks arranged one behind the other in the direction of the longitudinal axis varies over the width of the heat exchanger plate in the direction of the transverse axis. On each width section, in which the entry of the medium into the disks arranged one behind the other is intended, the comparatively largest number of disks is provided one behind the other. As the distance from the entrance increases, the number decreases in the direction of the transverse axis.

15 Claims, 6 Drawing Sheets

(56) References Cited

U.S. PATENT DOCUMENTS

| | | | | |
|---|---|---|---|---|
| 4,379,486 | A | 4/1983 | Kurihara | |
| 4,665,975 | A | 5/1987 | Johnston | |
| 4,844,151 | A | 7/1989 | Cohen | |
| 5,896,746 | A | 4/1999 | Platell | |
| 2007/0095515 | A1 | 5/2007 | Morishita et al. | |
| 2009/0013692 | A1 * | 1/2009 | Grieser et al. | 60/670 |

FOREIGN PATENT DOCUMENTS

| | | | |
|---|---|---|---|
| DE | 10 2006 013 503 | A1 | 1/2008 |
| DE | 10 2006 031 676 | A1 | 1/2008 |
| DE | 10 2009 050 500 | A1 | 4/2011 |
| DE | 10 2009 050 500 | B4 | 6/2011 |
| EP | 0 952 419 | A1 | 10/1999 |
| EP | 1 956 330 | A2 | 8/2008 |
| EP | 1 956 330 | A3 | 10/2009 |

OTHER PUBLICATIONS

International Preliminary Report on Patentability dated Feb. 15, 2012, with annex of 14 pages, for PCT/EP2010/006467 (22 pages).

Written Opinion of the International Searching Authority (undated) for PCT/EP2010/006467 (6 pages).

Written Opinion of the International Searching Authority (dated Nov. 14, 2011) for PCT/EP2010/006467 (6 pages).

* cited by examiner

HEAT EXCHANGER PLATE AND AN EVAPORATOR WITH SUCH A PLATE

CROSS REFERENCE TO RELATED APPLICATIONS

This is a continuation of PCT application No. PCT/EP2010/006467, entitled "HEAT EXCHANGER PLATE AND EVAPORATOR COMPRISING THE SAME", filed Oct. 22, 2010, which is incorporated herein by reference.

BACKGROUND OF THE INVENTION

1. Field of the Invention

The present invention relates to a heat exchanger plate for an evaporator and an evaporator with a plurality of heat exchanger plates which are stacked above one another, especially for a drive train of a motor vehicle, rail vehicle or a ship for example, comprising an internal combustion engine and a steam motor, with the heat of a hot medium such as a hot exhaust air flow, hot charge air, coolant, cooling agent or an oil of the internal combustion engine or a further unit provided in the drive train such as a vehicle air-conditioning system being used in the evaporator for generating the steam for the steam motor. The present invention is not limited to the application in a mobile drive train, but stationary drive trains such as in industrial applications or block-type thermal power stations can also be arranged accordingly.

2. Description of the Related Art

Heat exchanger plates or evaporators for utilizing the waste heat in a drive train, especially a drive train for a motor vehicle with an internal combustion engine, to which the present invention relates according to one embodiment, have long been known. The heat contained in an exhaust gas flow of the internal combustion engine is used for evaporating and/or superheating a working medium, and the vaporous working medium is then expanded in an expansion machine, i.e. a piston engine, turbine or screw machine, under release of mechanical power and is thereafter supplied to the evaporator again. The working medium is condensed after the expansion machine and then supplied to the evaporator again.

The utilization of the exhaust gas heat of the recirculated exhaust gas flow of modern diesel engines is especially advantageous, but also of petrol engines because in this case the offered heat is available at a high temperature level. At the same time, the cooling system of the vehicle is relieved because the heat flow of the recirculated exhaust gas is decoupled from the cooling system and is used in the evaporation circuit process for generating useful power. It is simultaneously or alternatively advantageous to use the residual exhaust gas flow for preheating, evaporation and/or superheating a working medium, which until now flowed out of the rear muffler to the ambient environment in an unused manner.

A further heat source which can be used at least for preheating, partial evaporation or even complete evaporation of the working medium in such a drive train is the heat contained in the coolant of a cooling circuit of the motor vehicle or the internal combustion engine. Further heat sources are obtained by exhaust gas recirculation and charge air cooling of vehicle engines and intermediate cooling in multi-step charging of the internal combustion engine. A separate burner unit can also be provided additionally or alternatively, or the heat of other heat sources in the drive train, especially the vehicle drive train, can be used such as engine oil, gear oil or hydraulic oil and electronic components, electric motors, generators or batteries that are provided there.

The mechanical power generated in the expansion machine from waste heat can be utilized in the drive train, either for driving auxiliary units or an electric generator. It is also possible to use the drive power directly for driving the motor vehicle, which means for traction, in order to thereby provide the internal combustion engine with a more compact size, to reduce fuel consumption or provide more drive power.

Various requirements are placed on the heat exchanger plates or the evaporators in the mentioned fields of application. On the one hand, they should offer high efficiency and work reliably. On the other hand, they should be produced at low cost and have a low overall volume and a low weight. Finally, the problem arises during use in the exhaust gas flow of an internal combustion engine that the volume flow of the exhaust gas will vary extremely during operation of the internal combustion engine and is further subject to temperature fluctuations. The exchanger plate or evaporator must be capable of securely managing such fluctuations in volume flow and temperature and securely ensuring the desired evaporation of the working medium in any possible state.

Document U.S. Pat. No. 4,665,975 A describes a plate heat exchanger, in which relatively large channels are provided which extend in the direction of the transverse axis for transverse distribution of the flow. Meandering channels which are switched in parallel and are tightly separated from one another are provided in the direction of flow before the comparatively large channels which extend in the direction of the transverse axis.

Further plate heat exchangers and methods for their production are disclosed in the publications DE 10 2006 013 503 A1, DE 30 28 304 A1.

Document EP 1 956 330 A2 describes a heat exchanger with a transverse flow distribution device for the fluid to be evaporated, in which the fluid to be evaporated flows laterally into the transverse flow distribution device in the direction of the transverse axis and is then redirected in the direction of the longitudinal axis in individual channels connected with one another via boreholes.

Document U.S. Pat. No. 3,983,191 A describes the lateral introduction of a fluid into a plate heat exchanger, in which the fluid flows at the top over a perforated rib in the direction of the transverse axis, whereas the steam is able to flow over the entire width of the rib through the same.

U.S. Pat. No. 4,249,595 describes the distribution of steam flowing from below into the heat exchanger via a strip with a plurality of nozzles. This injection via nozzles prevents that the fluid flowing from the top to the bottom is able to flow over the strip and will reach the flow distribution area for the steam.

The present invention is based on the object of providing a heat exchanger plate or an evaporator with a plurality of such heat exchanger plates which fulfills the mentioned requirements optimally.

SUMMARY OF THE INVENTION

The object in accordance with the invention is achieved by a heat exchanger plate for an evaporator 1.1 with a longitudinal axis and a transverse axis, with the transverse axis being disposed perpendicularly or substantially perpendicularly to the longitudinal axis, 1.2 with at least one flow channel which extends in the direction of the longitudinal axis of the heat exchanger plate through a heat supply area of the heat exchanger plate and conducts the medium to be evaporated, 1.3 with an inlet and an outlet for the medium to be evaporated, which are in a flow-conducting connection with the at least one flow channel extending in the direction of the longitudinal axis of the heat exchanger plate, 1.4 with a transverse flow distribution device being provided in the direction of the longitudinal axis between the inlet or the outlet and the at least one flow channel extending in the direction of the longitudinal axis, which transverse flow distribution device compensates pressure losses in the flow of the medium to be evaporated which are caused by the length of the flow path between the inlet and the various positions of the entrance into the at least one flow channel or—in the case of several flow channels extending adjacent to one another in the direction of the longitudinal axis—between the inlet and the entrances of the various flow channels, characterized in that 1.5 for forming the transverse flow distribution device in the direction of the longitudinal axis between the inlet and the at least one flow channel extending in the direction of the longitudinal axis a plurality of plates are arranged which are disposed one behind the other in the direction of the transverse axis, extend in the direction of the transverse axis and conduct the medium to be evaporated to the at least one flow channel extending in the direction of the longitudinal axis, with the plates having openings which enable a flow of the medium to be evaporated in the direction of the longitudinal axis with a comparatively higher flow resistance than in the direction of the transverse axis, and the number of the plates arranged behind one another in the direction of the longitudinal axis will vary over the width of the heat exchanger plate in the direction of the transverse axis, with the comparatively largest number of plates being arranged behind one another in the width section in which the entrance of the medium to be evaporated is provided into the successively arranged plates, and said number decreases with increasing distance from the entrance in the direction of the transverse axis, and the medium to be evaporated flows into the transverse flow distribution device in the direction of the longitudinal axis.

An evaporator can have a plurality of such heat exchanger plates.

The heat exchanger plate in accordance with the invention for an evaporator has a longitudinal axis and a transverse axis, with the transverse axis being disposed perpendicularly or substantially perpendicularly to the longitudinal axis. Furthermore, at least one flow channel is provided for the medium (working medium) to be evaporated, which flow channel extends substantially predominantly in the direction of the longitudinal axis of the heat exchanger plate through a heat supply region of the heat exchanger plate and conducts the medium to be evaporated. Several such flow channels are provided in an especially advantageous manner to extend at least predominantly in the direction of the longitudinal axis of the heat exchanger plate, through which the medium to be evaporated flows simultaneously under absorption of heat. Extending at least predominantly in the direction of the longitudinal axis shall mean that not only straight flow channels which extend precisely in the direction of the longitudinal axis can be provided, but also flow channels which in their progression have a certain section of flow conduction in the direction of the transverse axis or obliquely in relation thereto, e.g. by short webs or the like. However, the main direction of flow exists in the direction of the longitudinal axis and the through-flow pressure loss in the longitudinal direction is considerably lower than in the transverse direction insofar as flow channels are provided adjacent to one another—as will be explained below—which enable an exchange of medium to be evaporated among each other, with such exchange then usually occurring in the direction of the transverse axis or obliquely in relation thereto. Reference is made below only to the flow channel extending in the direction of the longitudinal axis for the sake of simplicity without confirming each time again that certain deviations in direction are permissible.

At least one inlet and one outlet are provided for the medium to be evaporated, which are in a flow-conducting connection with the at least one flow channel extending in the direction of the longitudinal axis of the heat exchanger plate. Usually, the medium to be evaporated will flow through the inlet in a fully liquid state and leave the heat exchanger plate in a partly or fully evaporated state.

A transverse flow distribution device is provided in accordance with the invention in the direction of the longitudinal axis between the inlet and the at least one flow channel extending in the direction of the longitudinal axis and/or between the at least one flow channel extending in the direction of the longitudinal axis and the outlet, which transverse distribution device compensates pressure losses in the flow of the medium to be evaporated which are caused by the length of the flow path between the inlet and the various positions of the inlet in the at least one flow channel or—in the case of several flow channels extending adjacent to one another in the direction of the longitudinal axis—between the inlet and the entrances of the various flow channels. As already explained above, the transverse flow distribution device can either be provided in the region between the inlet and the at least one flow channel extending in the direction of the longitudinal axis in which the pressure losses caused by the length of the flow path are provided when the medium to be evaporated passes through this region in different ways. It is achieved by the compensation of the various pressure losses caused by the length of the flow path that the medium to be evaporated will be distributed evenly among all flow channels extending in the direction of the longitudinal axis or the entire cross-section of a flow channel extending in the direction of the longitudinal axis, irrespective of the respective actual position of the inflow into the flow channel relative to the position of the inlet or—if a separate inflow channel is provided between the inlet and the transverse flow distribution device—irrespective of the position of the outlet from the inflow channel relative to the entrance into the at least one flow channel extending in the direction of the longitudinal axis. Alternatively, this even distribution of flow in the at least one flow channel extending in the direction of the longitudinal axis or all flow channels extending in the direction of the longitudinal axis can also be achieved by a respective pressure buildup from behind by a transverse flow distribution device, which is arranged in the direction of flow or in the direction of the longitudinal axis behind the at least one flow channel extending in the direction of the longitudinal axis and therefore between said flow channel and the outlet. It is further possible to provide a transverse flow distribution device before and after the at least one flow channel extending in the direction of the longitudinal axis, which may also cooperate concerning the pressure buildup from behind.

A transverse flow distribution device which is provided in the direction of the longitudinal axis between the at least one flow channel extending in the direction of the longitudinal axis and the outlet can also be used for compensating pressure losses caused by the length of the flow path between the outflow of the medium to be evaporated or the at least partly evaporated medium from the at least one flow channel and the outlet.

The transverse flow distribution device can be arranged in such a way that a complete compensation of the pressure losses caused by the length of the flow path will occur. The transverse flow distribution device is especially arranged in such a way that every fluid particle has the same temperature and/or the same speed when entering the at least one flow channel extending in the direction of the longitudinal axis. If the heat input into the medium to be evaporated is not constant over the area of the heat exchanger plate, then this can also lead to distinct imbalances in the pressure loss compensation by means of the transverse flow distribution device. This can also lead to dissymmetries in the transverse flow distribution device, especially when it is arranged—as will be described below in closer detail—with a plurality of flow-conducting plates.

The individual flow channels which are arranged in the direction of the longitudinal axis are delimited from one another in an especially advantageous manner by plates extending in the direction of the longitudinal axis. In accordance with one embodiment of the invention, an inflow channel, which can also be meandering, is provided between the inlet and the at least one flow channel extending in the longitudinal direction. The inflow channel can also be subdivided into individual partial channels by plates which in the embodiment as a meandering channel extend in the direction of the transverse axis. In accordance with a second embodiment, the plates are provided with openings so that a transverse flow of medium to be evaporated can occur between the individual flow channels. It is ensured in the first case that any vapor bubble that is forming is unable to expand to adjacent flow channels. According to the second embodiment, it can be achieved at best depending on the available flow cross-section of every single flow channel and the maximum volume flow of medium to be conducted that there will not be any complete blockage of an individual flow channel by a vapor bubble.

Such an inflow channel usually terminates with an outlet cross-section which covers only a part of the width of the exchanger plate, as seen in the direction of the longitudinal axis.

When the medium to be evaporated flows out of the inflow channel, it should be distributed as evenly as possible for optimal evaporation over the entire flow cross-section of the flow channel arranged in the direction of the longitudinal axis of the heat exchanger plate or over all adjacently arranged flow channels extending in the longitudinal direction of the heat exchanger plate. This can be achieved according to the invention in such a way that a transverse flow distribution device is provided between the meandering inflow channel and the at least one flow channel extending in the direction of the longitudinal axis, which transverse flow distribution device compensates pressure losses caused by the length of the flow path between the outlet from the inflow channel and the various positions of the inlet into the at least one flow channel or the various inlets of the various flow channels. The transverse flow distribution device increases the flow resistance on the comparatively short distances between the outlet of the medium to be evaporated from the inflow channel and the entrance into the at least one flow channel arranged in the longitudinal direction in comparison with the comparatively longer distances between said outlet and entrance points positioned further away. Such a transverse flow distribution device can also be provided which sets the flow resistance on the individual paths to be covered by the medium to be evaporated from the outlet and the individual entrance points in such a way that uneven heat supply via the heat exchange of plates is compensated.

The plates can be arranged symmetrically to the longitudinal axis of the heat exchanger plate. It is also possible to provide dissymmetries, especially in order to compensate differences in the heat input into the medium to be evaporated, as already explained above. This can lead to the consequence that the compensation of the pressure loss caused by the length of the flow path is incomplete, but that there is a purposeful relatively lower or higher pressure loss compensation on specific flow paths.

In accordance with a first embodiment, the pressure loss compensation caused by the length of the flow path can be achieved by plates provided in the direction of the longitudinal axis between the meandering inflow channel and the at least one flow channel extending in the direction of the longitudinal axis, which plates extend in the direction of the transverse axis and conduct the medium to be evaporated from the inflow channel in the direction towards the at least one flow channel extending in the direction of the longitudinal axis. The plates comprise openings which provide a comparatively small overall flow cross-section for the medium to be evaporated in the direction of the longitudinal axis and therefore produce a comparatively higher flow resistance in the direction of the longitudinal axis than in the direction of the transverse axis. The number of the plates arranged successively in the direction of the longitudinal axis is arranged in a varying manner over the width of the heat exchanger plate, which means in the direction of the transverse axis, with the comparatively largest number of plates being arranged behind one another on the width section in which the entrance of the medium to be evaporated is provided into the successively arranged plates, and the number decreases with increasing distance from the entrance in the direction of the transverse axis.

An alternative or additional measure for compensating pressure losses caused by the length of the flow path provides a throttling point in the direction of the longitudinal axis between the meandering inflow channel and the at least one flow channel extending in the direction of the longitudinal axis, which throttling point is provided over the entire width of the at least one flow channel extending in the direction of the longitudinal axis and causes the backing up of the medium to be evaporated over the entire width of the at least one flow channel extending in the direction of the longitudinal axis. Said backing up is so strong that the pressure loss via the throttling point—before the medium to be evaporated enters into the at least one flow channel extending in the direction of the longitudinal axis—far exceeds the various pressure losses caused by the length of the flow path before the throttling point.

The throttling point can be arranged for example by one or a plurality of webs which extend in the direction of the transverse axis or with an angle of less than 90° in relation to the transverse axis and which comprise or delimit at least one throttling opening. The web or the plurality of webs can delimit the throttling opening for example together with a base plate of the heat exchanger plate which forms the bottom or top of the inflow channel and the at least one flow channel arranged in the direction of the longitudinal axis. It is understood that the transverse flow distribution device can also be arranged differently, e.g. by adapting the individual flow channels which are especially arranged in the plates between the outlet of the medium to be evaporated from the inflow channel and the inlet or the various positions of the inlet into the at least one flow channel arranged in the direction of the longitudinal axis. As a result, individual flow channel contours can be provided with a smaller cross-section and others with a larger cross-section, or a flow channel will be deflected more often than the other one.

A respective transverse flow distribution device can also be provided on the outlet side of the at least one flow channel extending in the longitudinal direction of the heat exchanger plate, relating to the flow of the medium to be evaporated, which transverse distribution device compensates pressure losses induced by the length of the flow path between the outlet from the at least one flow channel and an outlet of the heat exchanger plate for the partly or completely evaporated medium. This transverse flow distribution device can especially be formed by plates and/or a web, as described above.

The present invention is not limited to embodiments with an inflow channel having a specific extension, especially a meandering one. Instead, the aforementioned configuration of the transverse flow distribution device with plates extending in the direction of the transverse axis or the throttling point, especially with a web, can also be provided in heat exchanger plates without such an inflow channel. It is only relevant that a transverse flow distribution device is provided in the direction of the longitudinal axis between the inlet and the at least one flow channel extending in the direction of the longitudinal axis or the plurality of flow channels extending in the direction of the longitudinal axis in order to ensure that the entire flow channel extending in the direction of the longitudinal axis or all flow channels extending in the direction of the longitudinal axis are supplied evenly with medium to be evaporated. Furthermore, embodiments of the transverse flow distribution device which are provided with a different configuration can be provided before or behind the at least one flow channel extending in the direction of the longitudinal axis as long as the pressure losses which are caused by the length of the flow path are compensated in the flow of the medium to be evaporated.

The inflow channel which extends in a meandering manner in accordance with one embodiment is formed in an especially advantageous way by a plurality of webs located on the heat exchanger plate or the aforementioned base plate, which webs extend in the direction of the transverse axis and are arranged one after the other in the direction of the longitudinal axis starting in an alternating manner on one each of the two opposite sides of the heat exchanger plate and extend up to a predetermined distance from the respective other side. When seen in the direction of the flow of the medium to be evaporated through the at least one flow channel arranged in the direction of the longitudinal axis, the first web starts on the left side and extends in the direction of the transverse axis up to close to the right side of the heat exchanger plate. The second web then starts in the direction of the longitudinal axis at a distance behind the first web on the right side and extends in the direction of the transverse axis up to close to the left side. The third web would then start on the left side again and so on. The advantageous meandering form is achieved thereby. The rearmost web in the direction of the longitudinal axis can then terminate either in the area of one of the two sides of the heat exchanger plate. If deviating from the above the medium to be evaporated shall not exit at one side of the heat exchanger plate from the inflow channel, two laterally opposing partial webs are provided as the last web which expose an opening in the central region or even outside of the center.

An evaporator in accordance with the invention for evaporating a fluid medium with a plurality of heat exchanger plates of the kind described herein which are stacked one above the other comprises at least one fluid inlet which is in flow-conducting connection with the inlets on the heat exchanger plates, a vapor outlet which is in flow-conducting connection with the flow channels on the heat exchanger plates which are arranged in the direction of the longitudinal axis, the vapor outlet occurs via the aforementioned outlets of the heat exchanger plate, and a channel conducting a heat carrier and/or any other heat source which supplies heat to the heat exchanger plates for evaporating the medium conducted through the inflow channels and the flow channels arranged in the direction of the longitudinal axis.

The guidance of the medium to be evaporated especially by means of the inflow channels and by means of the transverse flow distribution devices which are arranged in the direction of flow before the flow channels extending in the direction of the longitudinal axis and the flow channels arranged in the direction of the longitudinal axis occurs advantageously with the supply of heat in such a way that the medium to be evaporated is present in these transverse flow distribution devices and especially in the inflow channels in an exclusively or nearly fluid state and in an at least partly vaporous state in the flow channels arranged in the direction of the longitudinal axis of the heat exchanger plates.

A drive train of a motor vehicle arranged in accordance with the invention with an internal combustion engine and a steam motor, wherein the invention can also be used in a drive train outside of a motor vehicle, comprises an evaporator arranged in accordance with the invention which is arranged in the exhaust gas flow of the internal combustion engine. The heat from the exhaust gas flow of the internal combustion engine is transferred by means of the heat exchanger plates to the vapor of the vapor circuit of the steam motor, so that the evaporator also needs to be arranged in the vapor circuit.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
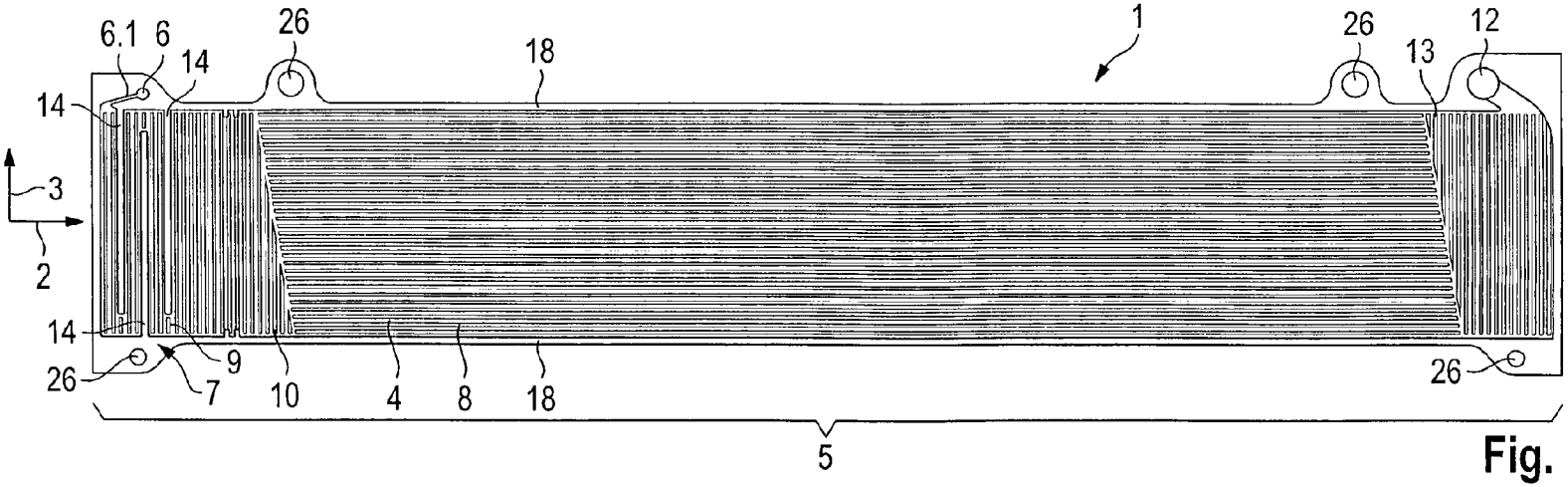
FIG. 1 shows a top view of a heat exchanger plate arranged in accordance with the invention with transverse flow distribution devices before and behind the flow channels extending in the direction of the longitudinal axis.

FIG. 1 shows a top view of a heat exchanger plate 1 in accordance with the invention for an evaporator, with a plurality of such heat exchanger plates 1 usually being provided to be stacked one above the other in a respective evaporator. A longitudinal axis 2 and a transverse axis 3 are shown in the drawing for easier spatial allocation.

A plurality of flow channels 4 extend over the axially largest area of the heat exchanger plate 1 in the direction of the longitudinal axis 2, which conduct the medium to be evaporated. In the illustrated embodiment, the individual flow channels 4 are separated from one another by the plates 8. As is also shown, the flow channels 4 further extend over the entire width of the heat exchanger plate 1, as seen in the direction of view towards the longitudinal axis 2 and in the direction of flow of the medium to be evaporated in the flow channels 4. Webs 18 are further only provided on the two lateral edges, which—as will be shown especially in FIG. 3—form the sidewalls of the flow-conducting region of the heat exchanger plate 1 and prevent that the medium to be evaporated will escape laterally from the heat exchanger plate 1.

An inlet 6 for the medium to be evaporated is provided on the first axial end. In the present case, the inlet 6 comprises at first a distributor borehole which extends through all stacked heat exchanger plates 1 (of which only one is shown in FIG. 1) and is in a flow-conducting connection in each heat exchanger plate 1 via a channel 6.1 with the actual inlet into an inflow channel 7 provided on each heat exchanger plate 1.

The inflow channel 7 extends from the first axial or face end of the heat exchanger plate 1 in the direction of the flow channels 4 arranged in the direction of the longitudinal axis 2. The inflow channel 7 is arranged in a meandering fashion in accordance with the invention; see the webs 14 extending in the direction of the transverse axis 3 which are arranged in the direction of the longitudinal axis 2 in an alternating fashion starting on one of the two opposite sides of the heat exchanger plate 1 and are arranged one behind the other extending to a predetermined distance in relation to the respective other side, so that the medium to be evaporated is respectively guided along every single entire web 14 in the direction of the transverse axis 3 until it flows through the distance at the lateral end of the web 14 in the direction of the longitudinal axis 2 to the next web 14. The webs 14 accordingly form a single meandering inflow channel 7, so that the entire medium to be evaporated which enters the heat exchanger plate 1 through the inlet 6 needs to flow through said single inflow channel 7 before it is distributed, as will be explained below in closer detail, among the different flow channels 4 which extend next to one another and are arranged in the direction of the longitudinal axis 2.

The flow channel of the inflow channel 7 is subdivided into individual partial channels by a plurality of plates 9 which extend in the direction of the transverse axis 3, as is illustrated in the drawings. The individual partial channels can be sealed against one another by the plates 9, with breakthroughs or recesses being provided in the region of the deflections which allow the desired meandering through-flow of the inflow channel 7. It is alternatively possible that the plates 9 comprise openings over the entire longitudinal extensions which connect the individual partial channels in a flow-conducting manner with each other. The same also applies to plates 8 which separate the flow channels 4 from one another which extend in the direction of the longitudinal axis 2.

The medium to be evaporated which exits through the space between the last plate 14 and the outside of the heat exchanger plate 1 out of the inflow channel 7 flows into an axial region between the inflow channel 7 and the channels 4 of the heat exchanger plate 1 which extend in the direction of the longitudinal axis 2, which heat exchanger plate is provided with a transverse flow distribution device for the purpose of optimal transverse distribution of the flow. In FIG. 1, the transverse flow distribution device comprises a plurality of plates 10 which extend in the direction of the transverse axis 3 and which are arranged one behind the other in the direction of the longitudinal axis 2 at a distance from one another. In the outer width section (shown at the bottom end of the heat exchanger plate 1 in FIG. 1) in which the medium to be evaporated flows out of the inflow channel 7, most plates 10 are arranged behind one another in the direction of the longitudinal axis 2, whereas on the other side of the heat exchanger plate 1 and therefore in the width section which is farthest away from the outlet of the inflow channel 7 the fewest plates 10 are arranged one behind the other in the direction of the longitudinal axis 2. This leads in the illustrated embodiment to a triangular outside shape of the plate region, wherein the angles of the outside shape can be chosen on the basis of the running lengths and the correlating pressure losses in the through-flow with medium to be evaporated in the longitudinal direction and transverse direction and can be determined for example by simulation calculations or measurements. Typically chosen angles lie in the range of 0° to 90°, preferably in the range of 0° to 60°.

Since the plates 10 are provided with openings, with such plates also being designated as intersected plates, the flow resistance for the medium to be evaporated which flows along the plates 10, which means in the direction of the transverse axis 3, is lower for a medium which flows in the direction of the longitudinal axis 2 through the openings in the plates 10. However, such a flow for the medium to be evaporated is therefore enabled through the openings in the plates 10 and therefore along a comparatively short distance in the direction of the longitudinal axis 2. Since the medium to be evaporated needs to flow through more plates 10 the shorter the path, the flow resistance on this short path is respectively higher per unit of distance. It can be achieved thereby that the flow resistance on the comparatively shortest path substantially corresponds to the flow resistance on the comparatively longest path and simultaneously to the flow resistance on all parts which are in between with respect to their length. For example, the flow resistance for the medium to be evaporated which flows out of the inflow channel 7 and straight in the direction of the longitudinal axis 2 into the flow channels 4 is as large as the one for the medium which flows out of the inflow channel 7 at first in the direction of the transverse axis 3 to the other side of the heat exchanger plate 1 and thereafter in the direction of the longitudinal axis 2 straight into the flow channels 4. As a result of this special arrangement of the plates 10, an even distribution of the medium to be evaporated which flows out of the inflow channel 7 can be achieved on all flow channels 4 extending in the direction of the longitudinal axis 2.

At the other axial end of the heat exchanger plate 1 or the flow channels 4 extending in the direction of the longitudinal axis 2, a respective second transverse flow distribution device is provided according to FIG. 1. In the present case, it comprises the plates 13 extending in the direction of the transverse axis 3. Said second transverse flow distribution device connects the plurality of flow channels 4 extending in the direction of the longitudinal axis 2 with an outlet 12 for the partly or completely evaporated medium. In the present case, the outlet 12 is arranged as a through-bore through the plurality of stacked heat exchanger plates 1 in order to join the evaporated medium flowing out of a heat exchanger plate 1 with the medium of the other plates and to then discharge the medium from the evaporator which comprises the respective heat exchanger plates.

The principle according to which the second transverse flow distribution device works corresponds precisely to the one of the first transverse flow distribution device in the direction of the longitudinal axis 2 between the inflow channel 7 and the flow channels 4. In this case too, the plates 13 form a flow path for the medium to be evaporated in the direction of the longitudinal axis 2 with a relatively higher flow resistance in comparison with the flow path extending through the plates 13 in the direction of the transverse axis 3. A comparatively higher number of plates 13 is provided in the direction of the longitudinal axis 2 in the width section in which the outlet 12 is provided or connected to the plates 13 (in the present case this is the uppermost width section shown in FIG. 1). The width section which is farthest away from the outlet 12 has the lowest number of plates in the direction of the longitudinal axis 2 (see the lowermost width section in FIG. 1). As a result, the flow resistance for the entire evaporated medium which flows out of the plurality of flow channels 4 and into the outlet 12 is substantially the same irrespective of the length of the distance covered by this evaporated medium.

Within the terms of production providing a low amount of rejects, the plates 10 and the plates 13 can be produced at first as a common field of plates and thereafter be separated from one another. This especially occurs by an oblique cut, so that the angle—relating to the direction of the longitudinal axis 2 in the direction of flow—corresponds at the rear end of the field with the plates 10 to the angle at the beginning of the field with the plates 13. In order to then achieve the desired varying number of plates 10, 13 over the width of the heat exchanger plate 1 with respect to the outlet of the inflow channel 7 or the inflow into the outlet 12, the outlet 12 is arranged on the opposite side like the outlet from the inflow channel 7.

FIG. 1 shows further that the plates 9 in the inflow channel are arranged in form of a plurality of integral fields of plates with a respective plurality of plates 9, with the L-shape of the fields of plates fully filling the intermediate space between two adjacent webs 14 of the inflow channel 7 and the lateral distance between one respective web 14 and the lateral end or, in this case, the web 18 of the heat exchanger plate 1 which forms the lateral wall.

The heat carrier, which can especially be present in fluid or gaseous form, especially the exhaust gas of an internal combustion engine, flows on the rear side of the illustrated heat exchanger plate 1 or through a further heat exchanger plate provided on the rear side of the illustrated heat exchanger plate 1, which further heat exchanger plate can be adjusted to the type of the heat carrier depending on its configuration. The heat carrier advantageously flows in a counter-current to the medium to be evaporated, which means in the illustration as shown in FIG. 1 from the right face side to the left face side of the heat exchanger plate 1. It is understood that other relative flows are possible, e.g. in a co-current flow or in cross flow, with the latter especially occurring by a meandering flow conduction of the heat carrier.

In the illustrated embodiment, no passage or pass-through is necessary for the heat carrier in the heat exchanger plate 1 as shown in FIG. 1. The illustrated boreholes 26 are rather used for the precise alignment of the individual heat exchanger plates 1, e.g. via pins guided through the boreholes 26. It would alternatively also be possible to provide openings or channels for the heat carrier in the heat exchanger plates 1, either for distributing the heat carrier to the different levels of the evaporator or conducting the heat carrier by means of the same heat exchanger plate 1 which also conducts the medium to be evaporated.

Figure 5:
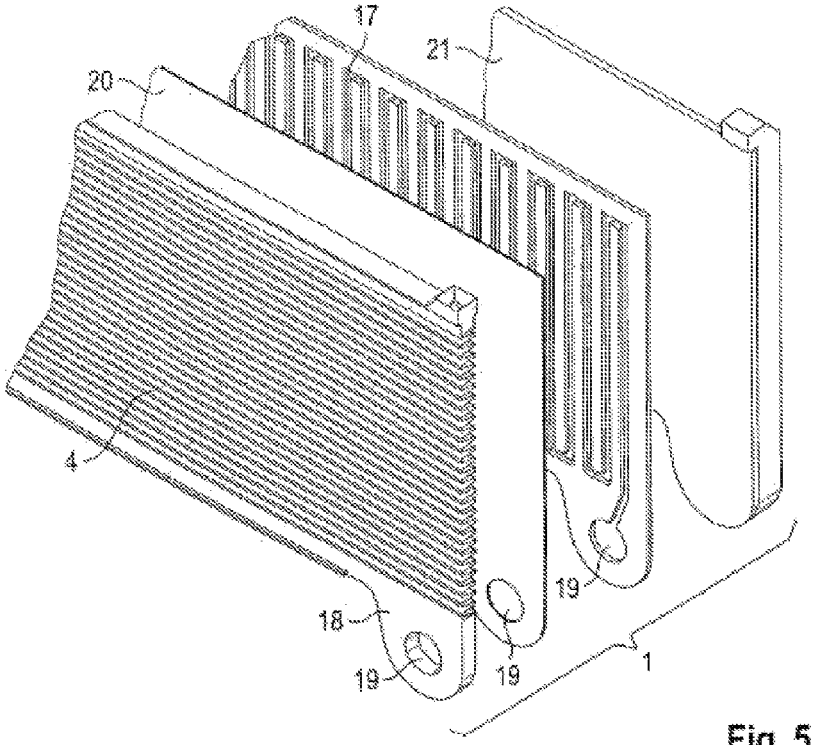
FIG. 5 shows an exemplary configuration of a heat exchanger plate in accordance with the invention with the side conducting the medium to be evaporated and the side which faces away therefrom and conducts the exhaust gas flow.

FIG. 5 shows an example for such a borehole 19 which also extends through the plane or plate which conducts the medium to be evaporated (see flow channels 4 which extend predominantly in the direction of the longitudinal axis). The heat exchanger plate 1 shown in FIG. 5 is arranged in layers, comprising four plates which are stacked one above the other in order to form a plane for flow conduction of the fluid to be evaporated and a plane for flow conduction of the carrier. The illustrated meandering conduction of flow for the heat carrier which enters the heat exchanger plate 1 through the borehole 19 is especially suitable for an evaporator which utilizes hot coolant or hot oils as a heat source. The meandering channel for the heat carrier is arranged on one side of a base plate 20, which faces away from the side which conducts the medium to be evaporated into the flow channels 4 arranged in the direction of the longitudinal axis. As a result of the meandering conduction of flow of the heat carrier with the conduction of flow in the direction of the longitudinal axis of the medium to be evaporated, a cross-flow heat exchanger is formed. The chosen layered configuration with the plate conducting the medium to be evaporated, i.e. the base plate 20, the plate conducting the heat carrier and the cover plate 21 which are stacked one above the other in a large number, allows an especially simple and cost-effective production.

Deviating from the indicated illustration, it is obviously also possible to choose the conduction of the fluids which are in heat-exchanging connection in such a way that a co-current heat exchanger or a counter-current heat exchanger or random mixed forms are formed.

With reference to FIG. 1 again, the heat supply area 5, in which the medium to be evaporated is supplied with heat from the heat carrier, extends both over the entire inflow channel 7 and also the (at least one) flow channel 4, especially further also the outlet area with the plates 13, advantageously over the entire extension of the heat exchanger plate 1 in the direction of the longitudinal axis 2 and/or the transverse axis 3.

Instead of the embodiment as shown in FIG. 1, the heat exchanger plate 1 could also comprise only one single transverse flow distribution device with a number of plates 10, 13 which vary over the width. It could be provided with the plates 10 or 13 according to the two illustrated transverse flow distribution devices, with only one of the two, especially the one in the direction of flow behind the flow channels 4, being omitted. It would alternatively also be possible to compensate pressure losses caused by the length of the flow paths with one single transverse flow distribution device, both on the inlet side and also the outlet side of the flow channels 4 extending in the direction of the longitudinal axis 2. Such a transverse flow distribution device would comprise a respectively more oblique outlet out of the field of plates with the plates 10 or alternatively a respectively more oblique inlet into the field of plates with the plates 13, or a field of plates with oblique outlet and oblique inlet, or other measures within the respective field of plates, especially by reducing the openings for the flow in the direction of the longitudinal axis 2.

Figure 2:
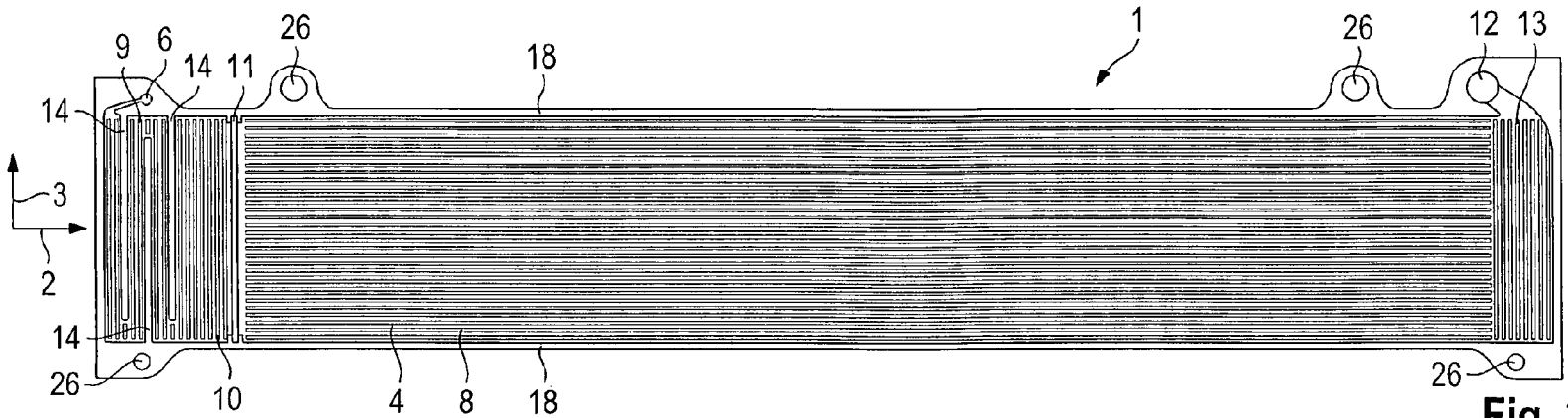
FIG. 2 shows a top view of a heat exchanger plate arranged in accordance with the invention with a throttling point before the flow channels extending in the direction of the longitudinal axis.

FIG. 2 shows an embodiment of a heat exchanger plate 1 which is similar to the one according to FIG. 1, with the same reference numerals being used for the same components. One difference is the arrangement of the transverse flow distribution device before the flow channels 4. It comprises a throttling point 11 which is formed by a web which extends in the direction of the transverse axis 3. Said throttling point 11 causes a backing up of the medium to be evaporated before it enters the flow channels 4. Said backing up produces a distribution of the medium to be evaporated over the entire width of the heat exchanger plate 1 in the direction of the transverse axis 3. Furthermore, the transverse flow distribution device is modified in the direction of flow behind the flow channels 4 in comparison with FIG. 1. It is especially advantageous when the plates 8 which extend in the direction of the longitudinal axis 2 and form the flow channels 4 rest in a flush manner on the throttling point 11 or the web provided for this purpose, so that no gap is formed and no transverse exchange of the flow can occur between the throttling point 11 and the flow channels 4.

It is understood that the throttling point 11 could also extend at an angle which is smaller than 90° in relation to the transverse axis 3 and can therefore be similarly positioned in an oblique manner as the axial end of the field with the plates 10 according to FIG. 1.

In the illustrated embodiment, plates 10 which also extend in the direction of the transverse axis are provided before the throttling point 11, but in this case with the same number of plates 10 in the direction of the longitudinal axis 2 over the entire width of the heat exchanger plate 1. In this case too, plates could also be provided here too as in FIG. 1.

Plates 13 are also provided in the direction of flow behind the flow channels 4, which plates extend in the direction of the transverse axis 3. The number of plates 13 arranged behind one another is also constant in this case over the entire width of the heat exchanger plate 1. An embodiment as shown in FIG. 1 would also be possible as an alternative for example.

Although FIGS. 1 and 2 show different embodiments for transverse flow distribution devices, further embodiments are possible. For example, the axial ends of the fields of plates can be delimited by several lines, especially two thereof, extending at an angle with respect to one another, or also by an arc shape. Furthermore, other measures with the same effect are possible, e.g. providing sponges or other structures that influence the flow resistance.

Figure 3:
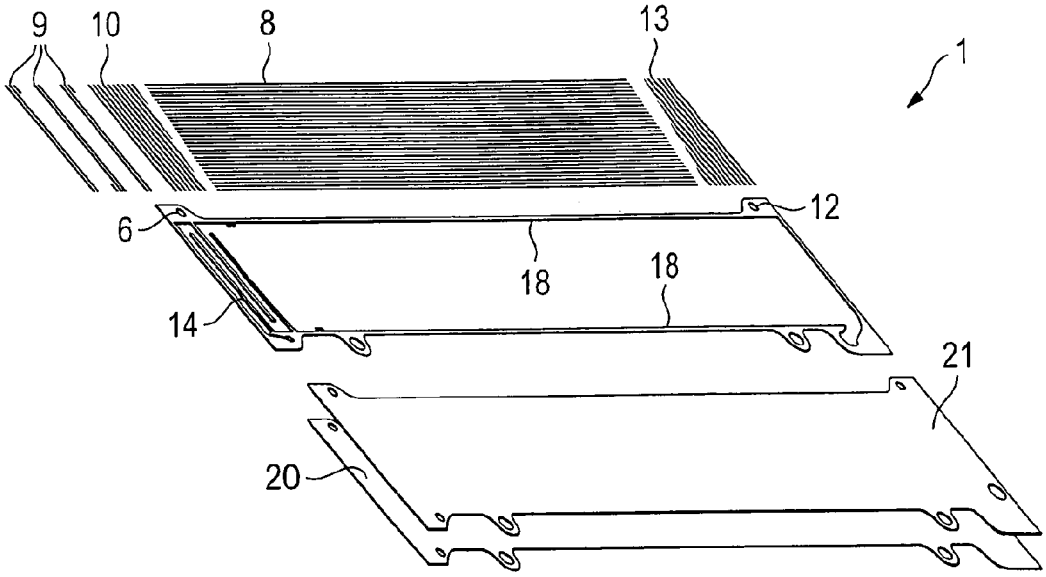
FIG. 3 shows an advantageous configuration of a heat exchanger plate according to FIG. 1 by a layered joining of various components.

FIG. 3 shows another possible layered configuration of a heat exchanger plate 1 arranged in accordance with the invention. It comprises a base plate 20 on which the webs 18 and the webs 14 can be placed. As is illustrated, the webs 18 and the webs 14 can also be provided with an integral configuration, especially in the form of an integral structural plate. The plates 9, 10, 8 and 13 can then be placed in the space enclosed by the webs 14, 18, before a further plate (the cover plate 21) is placed thereon from above in order to seal the space with the plates 9, 10, 8, 13 together with the webs 18. The plates 9, 10, 8 and 13 form the configuration in the inserted state as shown in FIG. 1.

In an especially advantageous manner, the structural plate with the webs 14 and 18 and the base plate 20 and the cover plate 21 can be soldered together or joined together by other material joining measures. For example, solder foils can be placed between the structural plate and the base plate 20 or the cover plate 21, or the required solder is made available by other known methods at the respective points. It is understood that non-material mounting of the aforementioned plates is also possible.

Figure 7:
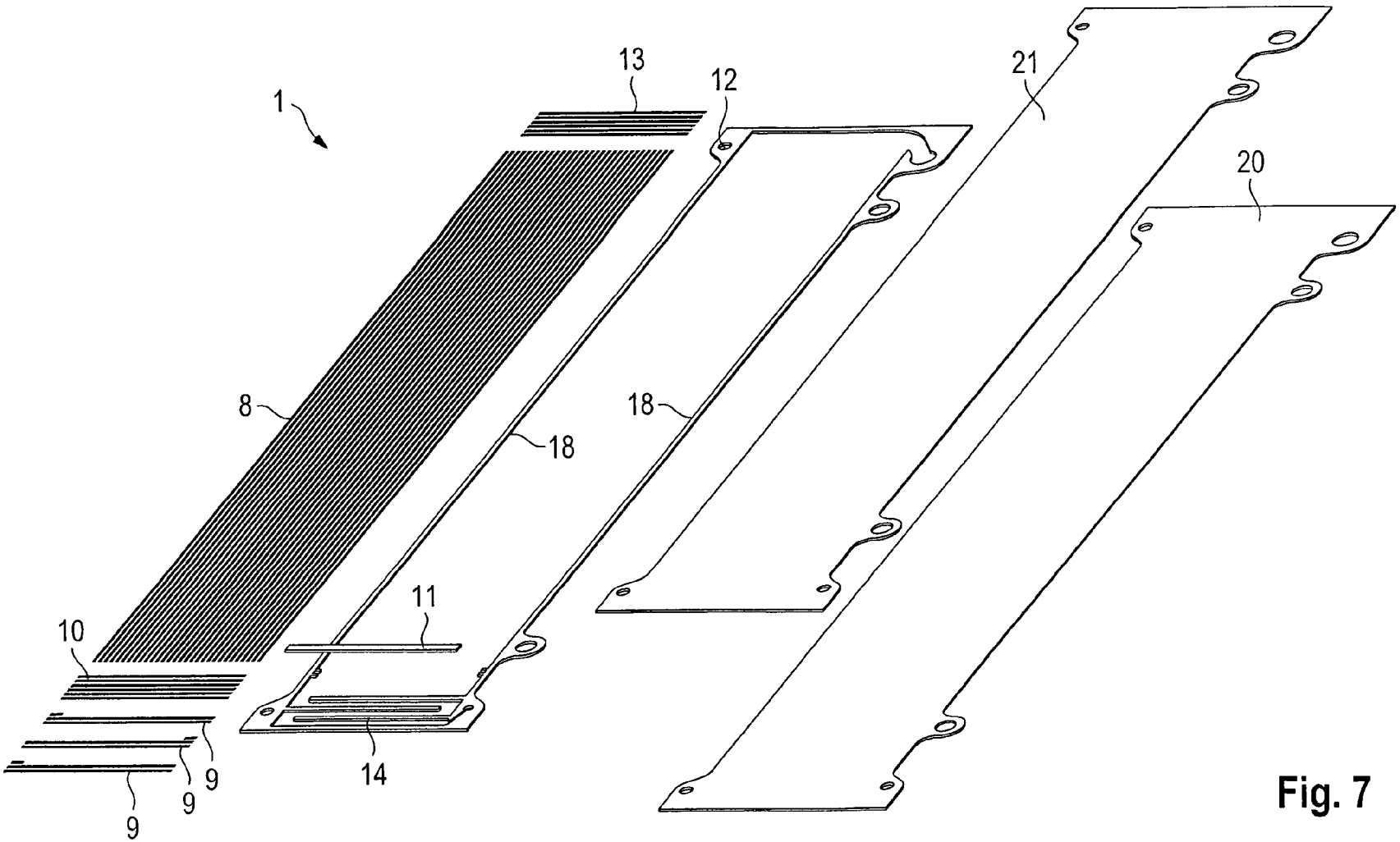
FIG. 7 shows a view in analogy to FIG. 3 for a heat exchanger plate according to FIG. 2.

FIG. 7 shows the respective components in an analogous representation in order to provide a configuration according to FIG. 2 with the throttling point 11 between the plates 10 and the plates 8; see the additionally inserted web which forms the throttling point 11 together with the base plate and/or the cover plate 21.

Figure 6:
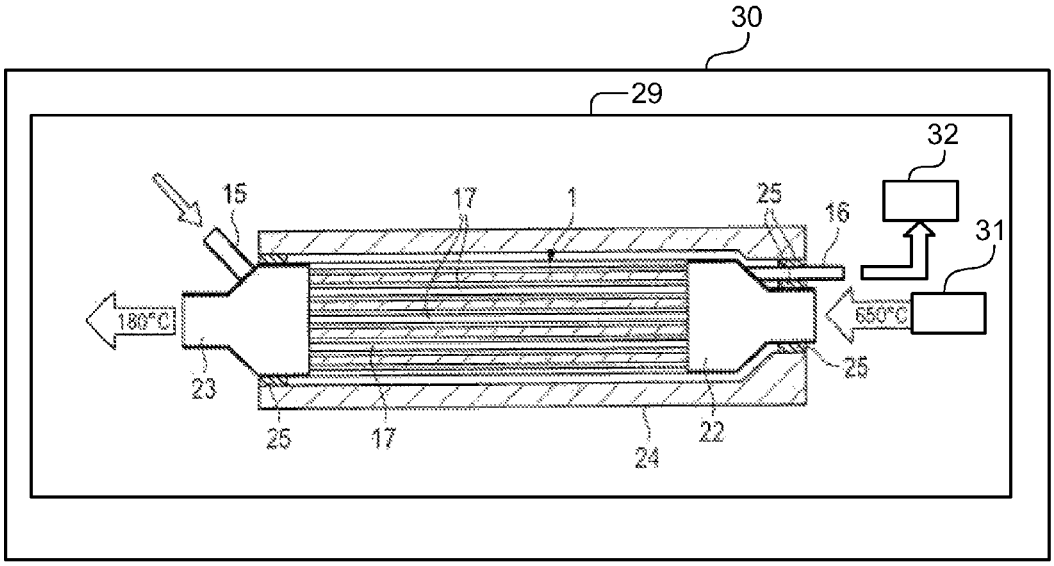
FIG. 6 shows a schematic view of an evaporator arranged in accordance with the invention with a plurality of respective heat exchanger plates.

The medium to be evaporated is guided between the base plate 20 and the cover plate 21. The heat carrier whose heat is used for evaporating the medium to be evaporated can then be conducted on at least one of the sides or both sides facing away, which in this case is beneath the base plate 20 and above the cover plate 21, especially in a channel 17 as shown in FIGS. 5 and 6. It would alternatively also be possible to heat one or both plates (base plate 20 and cover plate 21) by another measure, especially electrically or by induction, or to provide other measures for supplying heat to the medium to be evaporated.

Figure 4:
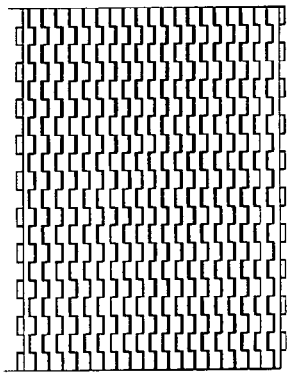
FIG. 4 shows a top view of a possible configuration of plates.

FIG. 4 shows an example for a field of plates in a top view, as can be used in individual plates or all plates 9, 10, 8, 13, as discussed herein. The plates therefore have a meandering shape in the direction of the main flow, which means in the plates 9, 10 and 13 as seen in the direction of the transverse axis 3 and in the plates 8 as seen in the direction of the longitudinal axis 2, the deflection effect of which could also be achieved with respect to the through-flow with straight plates with webs. Respective arc shapes or even straight plates can alternatively be used. The plates can be intersected or non-intersected, which means they can comprise openings for a secondary flow transversely to the direction of main flow, or the individual flow channels of the main flow can seal each other.

FIG. 6 shows an embodiment of an evaporator in a drive train 29 of a motor vehicle 30 arranged in accordance with the invention with a plurality of heat exchanger plates 1 which are stacked above one another. It comprises a fluid inlet 15 and a vapor outlet 16. Furthermore, an inlet 22 for a heat carrier and an outlet 23 for the same are provided. The inlet 22 for the heat carrier, especially for exhaust gas of an internal combustion engine 31, distributes the heat carrier among all heat-carrier-conducting channels 17 of the heat exchanger plates 1. The outlet 23 collects the heat carrier once it has flowed through the channel 17 and discharges it from the evaporator at a respectively reduced temperature. The medium to be evaporated which is introduced into the evaporator via the fluid inlet 15 is distributed among the various heat exchanger plates 1, flows there through the aforementioned channels, is collected again and is discharged via the vapor outlet 16 out of the evaporator in the vaporous state to a steam motor 32. The various components are sealed off against the ambient environment by suitable seals 25 in a housing 24. It is possible for example to evacuate the housing 24 in order to achieve the best possible insulation against the ambient environment. Further insulating layers can also be inserted.

The conduction of the medium to be evaporated through the evaporator now occurs in such a way—with the heat supply being arranged accordingly—that the medium to be evaporated is present in the inflow channels of the various heat exchanger plates 1 (see FIGS. 1 and 2) in the fluid state and the first vapor bubbles will only occur in the channels 4 extending in the direction of the longitudinal axis 2, i.e. in the phase transition region, in which the flow cross-section available for the medium to be evaporated is expanded considerably over the one of the inflow channels 7.

Figure 8:
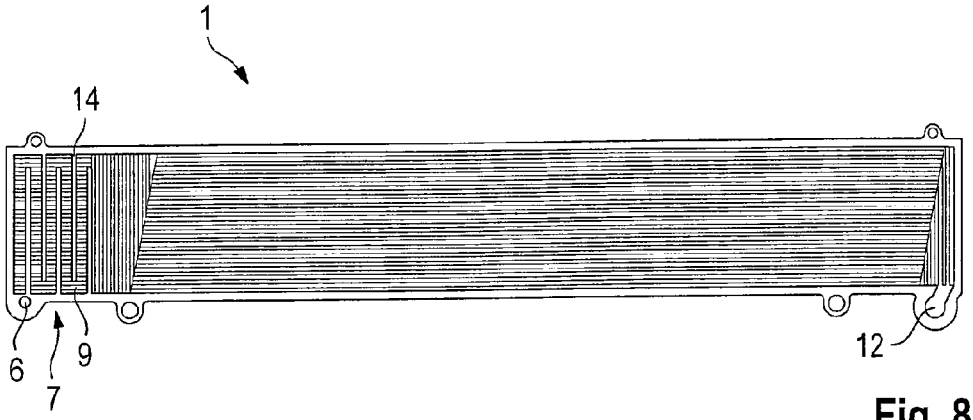
FIG. 8 shows an embodiment of a heat exchanger plate 1 which is modified in comparison with FIG. 1.

FIG. 8 shows a further embodiment according to the one as shown in FIG. 1. In the present case, the meandering inflow channel 7 comprises five webs 14 however, which originate in an alternating fashion on the two sides of the heat exchanger plate 1. The plates 9 are also arranged in the entire meandering inflow channel 7 in the form of an integrated field of plates.

Figure 9:
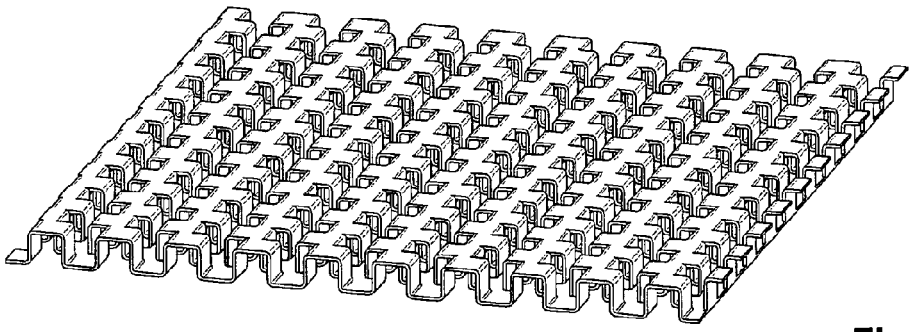
FIG. 9 shows an exemplary embodiment for a plate.

One example for a field of plates as can be used according to the present invention at the various points of the heat exchanger plate 1 is shown in FIG. 9. It is shown that the plates do not extend in a straight line but comprise comparatively short lateral webs.

Figure 10:
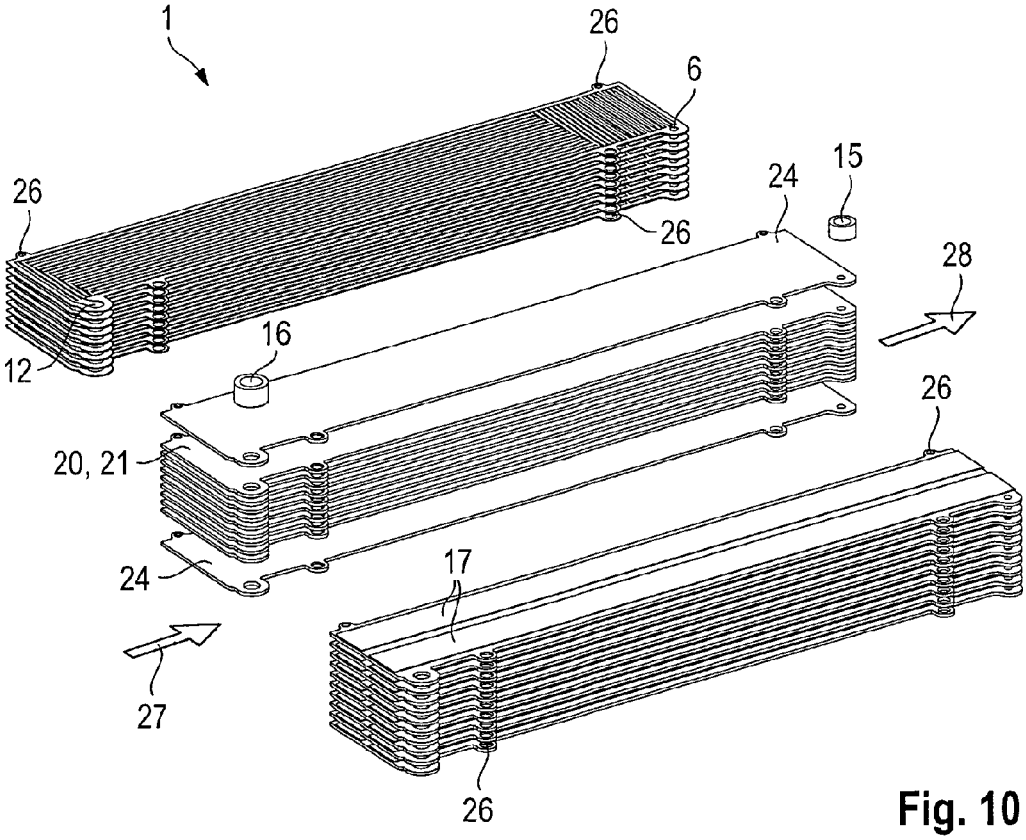
FIG. 10 shows an exploded view of an embodiment for an evaporator arranged in layers.

FIG. 10 shows an exploded view of an especially cost-effective configuration of an evaporator arranged in accordance with the invention. A plurality of stacked and aligned heat exchanger plates 1 are shown in the upper region, according to those of FIG. 8. The plates on the exhaust side are shown in the bottom region for forming the heat-carrier-conducting channels 17. The inflow and the outflow of the exhaust gas occur on the face side (see arrows 27 and 28). The heat exchanger plates 1 and the plates on the exhaust gas side with the channels 17 are now inserted in an alternating fashion between the base plates 20 and the cover plates 21 and are introduced into the housing 24 in order to form a layered configuration. The medium to be evaporated flows via the fluid inlet 15 into the evaporator and via the vapor outlet 16 out of the evaporator which is arranged according to the counter-flow principle.

Figure 11:
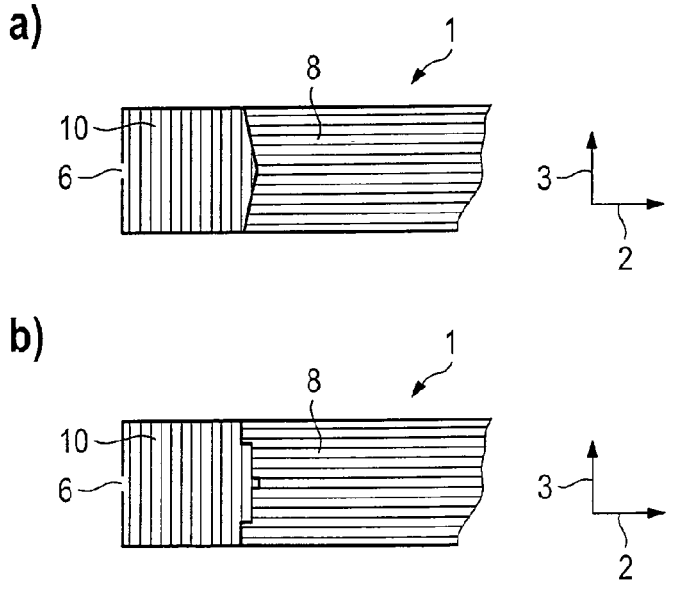
FIG. 11 shows examples of possible geometrical configurations for transverse flow distribution devices which comprise plates.

FIG. 11 shows further exemplary forms of a transverse flow distribution device with plates 10 in a schematic view. It is shown that the inlet 6 for the medium to be evaporated is arranged in the middle in the heat exchanger plate 1 according to FIG. 11. An inflow channel according to the previously shown embodiments is not provided. The inlet 6 could also be the outlet of an inflow channel by deviating from the illustration of FIG. 11.

The largest number of plates 10 are arranged one after the other in the direction of the longitudinal axis 2 in the width section in which the inlet 6 (or analogously the outlet of an inflow channel) is arranged. This leads according to FIG. 11*a* to an arrow shape for the rear end of the transverse flow distribution device with the plates 10, which on their part are advantageously arranged as an integral field of plates. A stepped form is chosen according to FIG. 11*b*. The latter comes with the advantage that the rear end can be adjusted better to the plates 10 which extend in parallel with respect to one another in the direction of the transverse axis 3.

It is understood that other shapes such as an arc or parabolic shape would be possible for example. It is also not mandatorily necessary that the symmetrical embodiments above the longitudinal axis 2 as shown in FIG. 11 are chosen.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat exchanger plate for an evaporator, comprising:

a longitudinal axis;

a transverse axis which is disposed perpendicularly to said longitudinal axis;

a heat supply area of the heat exchanger plate;

one of at least one flow channel and a plurality of said flow channels each of which extends in a direction of said longitudinal axis of the heat exchanger plate through said heat supply area of the heat exchanger plate and which conducts a medium to be evaporated;

an inlet;

an outlet, said inlet and said outlet being for said medium to be evaporated, said inlet and said outlet being in a flow-conduction connection with said at least one flow channel extending in said direction of said longitudinal axis of the heat exchanger plate;

a first transverse flow distribution device provided in said direction of said longitudinal axis between (a) one of said inlet and said outlet and (b) said at least one flow channel extending in said direction of said longitudinal axis, said first transverse flow distribution device compensating a plurality of pressure losses in a flow of said medium to be evaporated which are caused by a length of a flow path one of (a) between said inlet and a plurality of positions of an entrance into said at least one flow channel, and (b) in a case of said plurality of flow channels extending adjacent to one another in said direction of said longitudinal axis between said inlet and a plurality of entrances of said plurality of flow channels, said first transverse flow distribution device including a plurality of first plates, for forming said first transverse flow distribution device in said direction of said longitudinal axis between said inlet and said at least one flow channel extending in said direction of said longitudinal axis said plurality of first plates are arranged and are disposed one behind another in a direction of said longitudinal axis, extend in said direction of said transverse axis, and conduct said medium to be evaporated to said at least one flow channel extending in said direction of said longitudinal axis, said plurality of first plates having a plurality of first openings which enable said flow of said medium to be evaporated in said direction of said longitudinal axis with a comparatively higher flow resistance than in said direction of said transverse axis, a number of said plurality of first plates arranged behind one another in said direction of said longitudinal axis varying over a width of the heat exchanger plate in said direction of said transverse axis, a comparatively largest said number of said plurality of first plates being arranged behind one another in a width section in which an entrance of said medium to be evaporated is provided into successively arranged said plurality of first plates, said number decreasing with an increasing distance from said entrance into said successively arranged plurality of first plates in said direction of said transverse axis, said medium to be evaporated flowing into said first transverse flow distribution device in said direction of the longitudinal axis.

2. The heat exchanger plate according to claim 1, wherein said inlet of said medium to be evaporated is arranged on a lateral end of the heat exchanger plate.

3. The heat exchanger plate according to claim 1, further including a second transverse flow distribution device which is provided between said at least one flow channel extending in said direction of said longitudinal axis and said outlet, wherein said first transverse flow distribution device is provided in said direction of said longitudinal axis between said inlet and said at least one flow channel extending in said direction of said longitudinal axis.

4. The heat exchanger plate according to claim 1, further including a second transverse flow distribution device, wherein, for forming said second transverse flow distribution device in said direction of said longitudinal axis between said at least one flow channel extending in said direction of said longitudinal axis and said outlet a plurality of second plates are arranged and are disposed one behind another in said direction of said longitudinal axis, extend in said direction of said transverse axis, and conduct said medium which is one of (a) to be evaporated and (b) one of (i) is partly evaporated and (ii) is completely evaporated in a direction of said outlet, said plurality of second plates having a plurality of second openings which enable said flow of said medium which is one of (a) to be evaporated and (b) one of (i) is partly evaporated and (ii) is completely evaporated in said direction of said longitudinal axis with a comparatively higher flow resistance than in said direction of said transverse axis, a number of said plurality of second plates arranged behind one another in said direction of said longitudinal axis varying over said width of the heat exchanger plate in said direction of said transverse axis, a comparatively largest said number of said plurality of second plates being provided behind one another in a width section in which said outlet is provided, said number decreasing with an increasing distance from said outlet in said direction of said transverse axis.

5. The heat exchanger plate according to claim 4, wherein said first transverse flow distribution device is provided in said direction of said longitudinal axis between said inlet and said at least one flow channel extending in said direction of said longitudinal axis, and said second transverse flow distribution device is provided between said at least one flow channel extending in said direction of said longitudinal axis and said outlet.

6. The heat exchanger plate according to claim 1, further including a plurality of second plates extending in said direction of the longitudinal axis, said plurality of flow channels being provided, individual ones of said plurality of flow channels being adjacently arranged relative to one another and extending in said direction of said longitudinal axis, said plurality of flow channels being delimited from one another by said plurality of second plates extending in said direction of said longitudinal axis.

7. The heat exchanger plate according to claim 6, wherein said plurality of second plates extending in said direction of said longitudinal axis seal said plurality of flow channels extending in said direction of said longitudinal axis from each other so that there is no exchange of said medium to be evaporated between individual ones of said plurality of flow channels.

8. The heat exchanger plate according to claim 6, wherein said plurality of second plates extending in said direction of said longitudinal axis includes a plurality of second openings which enable an exchange of said medium to be evaporated between individual ones of said plurality of flow channels extending in said direction of said longitudinal axis.

9. The heat exchanger plate according to claim 6, wherein at least one of said plurality of second plates for delimiting said plurality of flow channels extending in said direction of said longitudinal axis and said plurality of first plates for forming said first transverse flow distribution device are provided respectively as a field of plates in which one of several and all of said plurality of second plates and said plurality of first plates are integrally connected with each other, the heat exchanger plate further including a base plate and a plurality of webs, each said field of plates being placed on said base plate of the heat exchanger plate between said plurality of webs delimiting the heat exchanger plate, said plurality of webs one of (a) being integral with said base plate and (b) being placed on said base plate.

10. The heat exchanger plate according to claim 9, further including a cover plate, each said field of plates being enclosed in a manner of a sandwich between said base plate and said cover plate.

11. The heat exchanger plate according to claim 9, further including a cover plate, each said field of plates being enclosed in a manner of a sandwich together with said plurality of webs between said base plate and said cover plate extending parallel to said base plate.

12. An evaporator for evaporating a medium which is a fluid, said evaporator comprising:

a plurality of heat exchanger plates which are stacked relative to one another, each of said plurality of heat exchanger plates including:

a longitudinal axis;

a transverse axis which is disposed perpendicularly to said longitudinal axis;

a heat supply area of the heat exchanger plate;

one of at least one flow channel and a plurality of said flow channels each of which extends in a direction of said longitudinal axis of the heat exchanger plate through said heat supply area of the heat exchanger plate and which conducts the medium to be evaporated;

an inlet;

an outlet, said inlet and said outlet being for the medium to be evaporated, said inlet and said outlet being in a flow-conduction connection with said at least one flow channel extending in said direction of said longitudinal axis of the heat exchanger plate;

a first transverse flow distribution device provided in said direction of said longitudinal axis between (a) one of said inlet and said outlet and (b) said at least one flow channel extending in said direction of said longitudinal axis, said first transverse flow distribution device compensating a plurality of pressure losses in a flow of the medium to be evaporated which are caused by a length of a flow path one of (a) between said inlet and a plurality of positions of an entrance into said at least one flow channel, and (b) in a case of said plurality of flow channels extending adjacent to one another in said direction of said longitudinal axis between said inlet and a plurality of entrances of said plurality of flow channels, said first transverse flow distribution device including a plurality of first plates, for forming said first transverse flow distribution device in said direction of said longitudinal axis between said inlet and said at least one flow channel extending in said direction of said longitudinal axis said plurality of first plates are arranged and are disposed one behind another in a direction of said longitudinal axis, extend in said direction of said transverse axis, and conduct the medium to be evaporated to said at least one flow channel extending in said direction of said longitudinal axis, said plurality of first plates having a plurality of first openings which enable said flow of the medium to be evaporated in said direction of said longitudinal axis with a comparatively higher flow resistance than in said direction of said transverse axis, a number of said plurality of first plates arranged behind one another in said direction of said longitudinal axis varying over a width of the heat exchanger plate in said direction of said transverse axis, a comparatively largest said number of said plurality of first plates being arranged behind one another in a width section in which an entrance of the medium to be evaporated is provided into successively arranged said plurality of first plates, said number decreasing with an increasing distance from said entrance into said successively arranged plurality of first plates in said direction of said transverse axis, the medium to be evaporated flowing into said first transverse flow distribution device in said direction of the longitudinal axis;

a fluid inlet which is in a flow-conducting connection with each said inlet on said plurality of heat exchanger plates;

a vapor outlet which is in a flow-conducting connection with each said outlet on said plurality of heat exchanger plates;

a channel conducting at least one of a heat carrier and any other heat source in order to supply a heat from one of said heat carrier and said other heat source to said plurality of heat exchanger plates for evaporating the medium which is conducted by said plurality of heat exchanger plates through said plurality of flow channels arranged in said direction of said longitudinal axis.

13. The evaporator according to claim 12, wherein a conduction of the medium to be evaporated by way of said first transverse flow distribution device which is arranged in a direction of said flow before said plurality of flow channels extending in said direction of said longitudinal axis and said plurality of flow channels arranged in said direction of said longitudinal axis occurs with a supply of said heat in such a way that the medium to be evaporated is present in said transverse flow distribution device in one of a completely fluid state and a partly fluid state and is present in an at least partly vaporous state in said plurality of flow channels.

14. A drive train, comprising:

an internal combustion engine, said internal combustion engine generating an exhaust gas flow;

a steam motor, said steam motor being arranged in a steam circuit;

an evaporator for evaporating a medium which is a fluid, said evaporator comprising:

a plurality of heat exchanger plates which are stacked relative to one another, each of said plurality of heat exchanger plates including:

a longitudinal axis;

a transverse axis which is disposed perpendicularly to said longitudinal axis;

a heat supply area of the heat exchanger plate;

one of at least one flow channel and a plurality of said flow channels each of which extends in a direction of said longitudinal axis of the heat exchanger plate through said heat supply area of the heat exchanger plate and which conducts the medium to be evaporated;

an inlet;

an outlet, said inlet and said outlet being for the medium to be evaporated, said inlet and said outlet being in a flow-conduction connection with said at least one flow channel extending in said direction of said longitudinal axis of the heat exchanger plate;

a first transverse flow distribution device provided in said direction of said longitudinal axis between (a) one of said inlet and said outlet and (b) said at least one flow channel extending in said direction of said longitudinal axis, said first transverse flow distribution device compensating a plurality of pressure losses in a flow of the medium to be evaporated which are caused by a length of a flow path one of (a) between said inlet and a plurality of positions of an entrance into said at least one flow channel, and (b) in a case of said plurality of flow channels extending adjacent to one another in said direction of said longitudinal axis between said inlet and a plurality of entrances of said plurality of flow channels, said first transverse flow distribution device including a plurality of first plates, for forming said first transverse flow distribution device in said direction of said longitudinal axis between said inlet and said at least one flow channel extending in said direction of said longitudinal axis said plurality of first plates are arranged and are disposed one behind another in a direction of said longitudinal axis, extend in said direction of said transverse axis, and conduct the medium to be evaporated to said at least one flow channel extending in said direction of said longitudinal axis, said plurality of first plates having a plurality of first openings which enable said flow of the medium to be evaporated in said direction of said longitudinal axis with a comparatively higher flow resistance than in said direction of said transverse axis, a number of said plurality of first plates arranged behind one another in said direction of said longitudinal axis varying over a width of the heat exchanger plate in said direction of said transverse axis, a comparatively largest said number of said plurality of first plates being arranged behind one another in a width section in which an entrance of the medium to be evaporated is provided into successively arranged said plurality of first plates, said number decreasing with an increasing distance from said entrance into said successively arranged plurality of first plates in said direction of said transverse axis, the medium to be evaporated flowing into said first transverse flow distribution device in said direction of the longitudinal axis;

a fluid inlet which is in a flow-conducting connection with each said inlet on said plurality of heat exchanger plates;

a vapor outlet which is in a flow-conducting connection with each said outlet on said plurality of heat exchanger plates;

a channel conducting at least one of a heat carrier and any other heat source in order to supply a heat from one of said heat carrier and said other heat source to said plurality of heat exchanger plates for evaporating the medium which is conducted by said plurality of heat exchanger plates through said plurality of flow channels arranged in said direction of said longitudinal axis, said exhaust gas flow as said heat carrier flowing through said channel conducting said heat carrier, said evaporator being supplied with a steam of said steam circuit for evaporating the medium by way of said heat from said exhaust gas flow.

15. The drive train according to claim 14, wherein the drive train is for a motor vehicle.

* * * * *